United States Patent [19]

Forster

[11] Patent Number: 4,486,362

[45] Date of Patent: Dec. 4, 1984

[54] PROCESS AND ARRANGEMENT FOR THE FORMATION OF AN IGNITABLE MIXTURE FROM LIQUID FUEL AND COMBUSTION AIR

[75] Inventors: Siegfried Forster, Alsdorf; Hubert Jaegers, Julich; Hans Kammerling, Eschweiler; Peter Quell, AACHEN-HAAREH, all of Fed. Rep. of Germany

[73] Assignee: Kernforschungsanlage Jülich Gesellschaft mit beschrankter Haftung Julich, Fed. Rep. of Germany

[21] Appl. No.: 385,799

[22] Filed: Jun. 7, 1982

[30] Foreign Application Priority Data

Jun. 9, 1981 [DE] Fed. Rep. of Germany ..... 3122770

[51] Int. Cl.[3] ..... B01F 3/04

[52] U.S. Cl. ..... 261/138; 261/47; 261/95; 261/109; 261/112; 261/39 A

[58] Field of Search ..... 261/47, 99, DIG. 65, 261/104, 95, 109, 112, 39 A, 138

[56] References Cited

U.S. PATENT DOCUMENTS

| | | | |
|---|---|---|---|
| 1,184,889 | 5/1916 | Stevens | 261/47 |
| 1,207,680 | 12/1916 | Broderick | 261/47 |
| 1,403,716 | 1/1922 | Speed | 261/47 |
| 1,625,141 | 4/1927 | Nelson | 261/47 |
| 1,707,229 | 4/1929 | Lloyd | 261/47 |
| 1,857,565 | 5/1932 | Pahl et al. | 261/99 |
| 1,914,032 | 6/1933 | Mackan | 62/104 |
| 2,530,716 | 11/1950 | Meynier | 261/99 |
| 2,638,330 | 5/1953 | Morgenroth | 261/47 |
| 3,207,202 | 9/1965 | Lingl . | |
| 3,836,129 | 9/1974 | Perelmutr et al. | 261/47 |

FOREIGN PATENT DOCUMENTS

| | | | |
|---|---|---|---|
| 519203 | 3/1940 | United Kingdom | 261/DIG. 65 |

*Primary Examiner*—Tim Miles

*Attorney, Agent, or Firm*—Scully, Scott, Murphy & Presser

[57] ABSTRACT

A process and an arrangement for the formation of an ignitable mixture from liquid fuel and combustion air, wherein preheated combustion air is conducted with a flow chamber along a surface which is moistened with fuel for take-up of fuel. In the process and arrangement, combustion air is conveyed into the flow chamber in the flow direction of the fuel which streams off the surface moistened by the fuel under the effect of gravity. Achieved hereby is an intensive contacting between the combustion air and the fuel. The fuel is dosed in excess so as to constantly afford a sufficient quantity of fuel for vaporization. During the through flow of the combustion air, there is formed, in the contact with the fuel, a saturated fuel-air mixture in conformance with the temperature of the preheated combustion air and the temperature of the fuel. Concurrently, care is taken that the trickling film of the fuel which is formed by gravitation as well as the drag effect exerted by the combustion air passing through the flow chamber can freely exit from the flow chamber at the foot of the surface moistened by fuel, to the extent in which the fuel is not taken up through vaporation by the combustion air in the flow chamber.

13 Claims, 7 Drawing Figures

35
34
17
38
40
39
32
III
31
41
42
A'
A
III
21
20a
33
24
20
13a
15
16
27
18
19
28
22
26
29
30
23
25

PROCESS AND ARRANGEMENT FOR THE FORMATION OF AN IGNITABLE MIXTURE FROM LIQUID FUEL AND COMBUSTION AIR

BACKGROUND OF THE INVENTION

1. Field of the Invention

The present invention relates to a process for the formation of an ignitable mixture from liquid fuel and combustion air, wherein preheated combustion air is conducted within a flow chamber along a surface which is moistened with fuel for take-up of fuel, as well as to an arrangement for the implementation of the process.

2. Discussion of the Prior Art

The formation of ignitable mixtures through the vaporization of fuel in preheated combustion air which is conveyed over a surface moistened by fuel is known in burners, wherein liquid fuel passes through the porous walls of a fuel chamber which is arranged in a flow chamber traversed by preheated combustion air. The fuel vaporized from the porous walls of the fuel chamber into the preheated combustion air so as to form an ignitable fuel-air mixture which is introduceable into a combustion zone in which it can be ignited and combusted. Reference may be had, in this connection, to German patent applications Nos. P 29 12 519.7-13, P 30 13 428.2-13, and P 30 47 702.2. Burners of this type are destined for utilization in industrial furnaces as well as for smaller sized heat generators.

In order to attain the most efficient formation of the ignitable mixture and a complete residue-free combustion, there is required an extremely precisely metered fuel dosage. In the previously mentioned burners this is attempted by adjustment of the oil pressure in the fuel chamber. The oil pressure is so regulated, that the fuel quantity which passes through the porous walls of the fuel chamber is completely taken up by the combustion air flowing within the flow chamber. At an excessively high fuel infeed it is possible that fuel droplets can be pulled along by the combustion air so as to cause an incomplete combustion, which leads to fuel losses and also to environmental contamination. Also disadvantageous is an infeed of fuel into the flow chamber which is too low. The preheated combustion air, in essence, then heats the porous walls of the fuel chamber so as to present the danger that the fuel will crack on the surface moistened by the fuel and form residues which will prevent the further inlet of fuel through the porous walls. Consequently, there is required an extremely sensitive regulation of the burner which will react to changing conditions with only minor delay.

SUMMARY OF THE INVENTION

Accordingly, it is an object of the present invention to provide a process for the formation of an ignitable mixture in which the required fuel-air mixture can be adjusted for different operating conditions without considerable demands on the regulation.

The foregoing object is achieved in a process pursuant to the invention in that the combustion air is conveyed into the flow chamber in the flow direction of the fuel which streams off the surface moistened by the fuel under the effect of gravity. Achieved hereby is an intensive contacting between the combustion air and the fuel. The fuel is dosed in excess so as to constantly afford a sufficient quantity of fuel for vaporization. During the through flow of the combustion air, there is formed, in the contact with the fuel, a saturated fuel-air mixture in conformance with the temperature of the preheated combustion air and the temperature of the fuel. Concurrently, care is taken that the trickling film of the fuel which is formed by gravitation as well as the drag effect exerted by the combustion air passing through the flow chamber can freely exit from the flow chamber at the foot of the surface moistened by fuel, to the extent in which the fuel is not taken up through vaporation by the combustion air in the flow chamber.

The fuel quantity which is vaporized from the fuel film into the preheated combustion air is determinable with a good approximation pursuant to the socalled "Levis' law" referring hereby in particular to F. Kneule, "Das Trocknen", Grundlagen der Chemischen Technik, Vol 6, publishers Sauerlander and Co. Aarau, Switzerland, 1959. The vaporized quantity of fuel is dependent upon the temperature of the preheated combustion air and upon the temperature of the fuel on the surface of the formed fuel film.

In a further embodiment of the invention, the quantity of combustion air which is contacted by the fuel film is regulated through control of an air flow which is conducted through a bypass, which branches off prior to the entry of the combustion air into the flow chamber and which is directly conveyed into the fuel-air mixture exiting from the flow chamber. Thereby, the ignitable mixture which is to be introduced into the fuel chamber is adjustable within a second regulating range.

A uniform film formation on the surface which is to be moistened by fuel is preferably achieved through the delivery of the fuel at the combustion air inlet to the flow chamber. Eliminated thereby is a fuel chamber with porous walls, as has been utilized up to now in known burners with fuel vaporization. The fuel film formation and the adherence of the fuel is supported by roughening of the surface of the wall which is moistened by the fuel.

An arrangement for implementation of the process is set forth in that the flow chamber is so connected to a combustion air infeed and to a discharge for the fuel-air mixture which is formed in the flow chamber, that the combustion air will pass through the flow chamber in the flow direction of the fuel which streams off the moistenable surface under the effect of gravity. At the foot of the surface which is moistened by the fuel there is provided an outlet for excess fuel.

The moistenable surface is preferably cylindrically shaped and arranged coaxially with a perpendicularly extending flow passageway which conveys the combustion air. As an outlet for excess fuel at the foot of the moistenable surface there is provided a gap which has a gap width corresponding to at least the film thickness of the fuel film at the foot of the moistenable surface. The excess fuel can freely flow off through this gap. The fuel-air mixture which flows to the combustion chamber does not contain any undesired fuel droplets.

In a further embodiment of the invention provision is made for the surface which is moistenable by the fuel to coaxially encompass the flow chamber. The inner wall of the flow chamber forms a conduit whose exposed inner space serves for the discharge of the fuel-air mixture. The surface which is to be moistened by the fuel is roughened. This leads to a uniform film formation. In order to be able to regulate the fuel-air mixture which is formed during the contacting between the combustion air and the fuel film, the surface which is moistenable by the fuel is arranged so as to be displaceable within the flow chamber. The size of the contact surface between the combustion air and the fuel film is thus adjustable.

Furthermore, there is provided a regulating unit by means of which the ignitable mixture which is to be introduced into the combustion chamber can be extremely sensitively adjusted over a wide range. Accordingly, the composition of the ignitable mixture is regulated through a bypass conduit which connects the combustion air inlet ahead of the entry for the combustion air into the flow chamber with the discharge for the fuel-air mixture, so that the quantity of combustion air which flows through the bypass into the outlet is adjustable with the aid of a regulator. Preferably, the regulator is in an operative connection with a temperature sensor which is located in the combustion air inlet. Controlled in dependence upon the temperature of the preheated combustion air is the portion of the combustion air quantity which enters into the flow chamber. The fuel-air mixture which exits from the flow chamber and the component of the combustion air which is introduced into the fuel-air mixture by means of the bypass, thus determines the composition of the ignitable mixture which is conducted to the combustion chamber. For the adjustment of the two branch flows of the combustion air, of which one is conveyed through the flow chamber and the other through the bypass, the regulator preferably includes at least one regulating element which concurrently adjusts the flow cross-section in the bypass which is to be passed through by the combustion air and that in the combustion air inlet ahead of the entry of the combustion air into the flow chamber. Thereby the flow cross section at the inlet to the flow chamber is variable in such a manner wherein, at a fully opened bypass, there is blocked the inlet of combustion air to the flow chamber. Instead of closing off the inlet of the combustion air to the flow chamber, with the same effect there can also be blocked a flow cross-section in the outlet of the fuel air mixture from the flow chamber ahead of the connection of the bypass flow. Preferably, at a fully opened bypass, the inlet of the combustion air to the flow chamber, as well as the discharge of the fuel mixture from the flow chamber are closed off so that, during cold start and upon switching off of the arrangement, no undesirable fuel vapor will enter into the combustion air which flows through the bypass.

In another embodiment of the invention there are provided mutually displaceable regulating elements. Preferably, the regulating elements are constructed tubularly-shaped and are coaxial relative to each other so that at least one of the regulating elements is adjustably supported and concurrently varies the flow cross section of the bypass and the flow cross-section of the combustion air inlet and/or one flow cross section in the discharge for the fuel-air mixture. The regulating elements include recesses which are adjustable with respect to recesses in a stationary regulating element for effecting variation of the flow cross-sections. For assumption of the extreme positions of the regulator, in essence, on the one hand, the "off" position in which the bypass is fully opened and the flow chamber is closed off and, on the other hand, the maximum operating position in which the bypass is closed off and the entire combustion air serves for the take-up of fuel, latching devices are located on the regulator. Such a latching device is of special significance in the "off" position for to reasons of safety and for the cold start.

Preferably the adjustable regulating element is constructed as an axially displaceable sleeve which closes the flow chamber at an opened bypass. Such a regulating element, which is constructed in the simplest manner, conforms to the requirements that are for a sensitive regulation, as well as to the desired robust configuration for the regulator in conformance with the application of the arrangement. The sleeve is arranged so as to be displaceable against the action of the spring by means of a temperature sensor in dependence upon the temperature of the preheated combustion air flowing in the combustion air infeed. Through the intermediary of a switch, the sleeve can be fixed in that position in which the bypass is fully opened. The switch serves concurrently as a safety switch.

A suitable construction is provided for a fuel storage into which there is conveyed the excess fuel at the foot of the surface moistenable by the fuel by means of a fuel conduit, as described hereinbelow. A fuel conduit is connected with the fuel storage and communicates with a fuel distributor at the head of the surface which is to be moistened by the fuel. The excess fuel is thus conveyed within a closed circuit and again stands available for the formation of the fuel-air mixture. From the fuel distributor the fuel flows under the effect of gravity onto the surface which is to be moistened. For effecting preheating of the fuel, the fuel conduit is connected with a heat exchanger which is located within the combustion air infeed. The fuel film in the flow chamber thus evidences a temperature which lies only slightly below the temperature at which the combustion air enters the flow chamber, and which is so high that all oil fractions in the fuel can vaporize in the introduced combustion air. For the cold start of the arrangement in which preheated combustion air is not yet present, the fuel storage includes a heating element for the preheating of the fuel. In order to be able to counteract any overheating of the fuel during operation, a cooling element for the fuel is provided in the fuel storage.

So that the produced ignitable mixture will not cool off in an undesired manner up to its entry into the combustion chamber, at the discharge for the fuel-air mixture and/or at a gas conduit which conveys the ignitable mixture to the fuel chamber, there is provided a thermal insulation.

BRIEF DESCRIPTION OF THE DRAWINGS

Reference may now be had to the following detailed description of exemplary embodiments of the invention, taken in conjunction with the accompanying drawings; in which.

DETAILED DESCRIPTION

Figure 1:
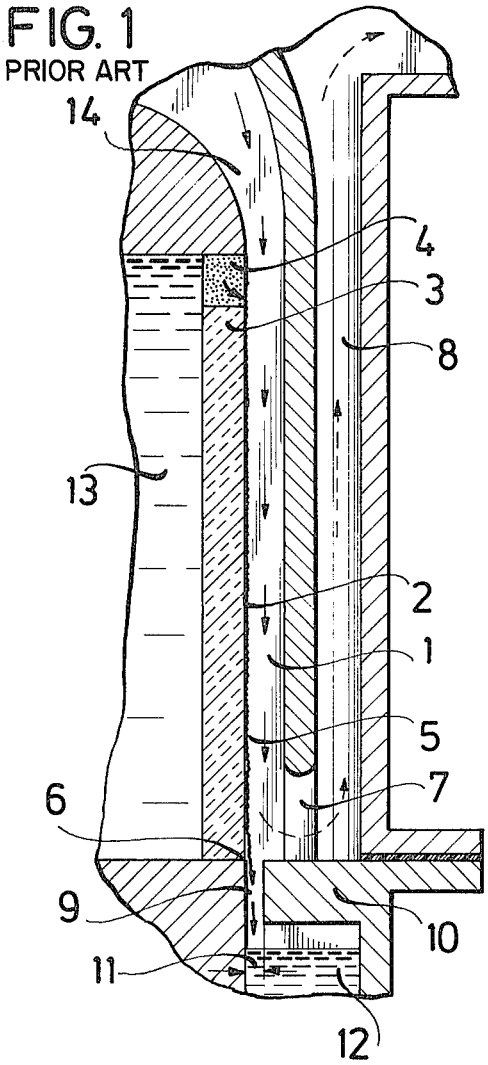
FIG. 1 PRIOR ART
FIG. 1 illustrates a generally diagrammatic representation of a flow chamber for the formation of an ignitable mixture.

Illustrated generally diagrammatically in FIG. 1 is a flow chamber 1 for the formation of an ignitable mixture from a liquid fuel and combustion air. Within the flow chamber 1, the combustion air is conducted over the surface 2 of a wall 3, which surface is moistenable by fuel. The combustion air streams through the flow chamber in the flow direction of the fuel which streams off the surface under the effect of gravity. The flow direction of the combustion air is shown in the flow chamber of FIG. 1 by means of arrows having the white background. The fuel is uniformly distributed at the head or upper end of the surface 2 by means of a fuel distributor 4 and trickles down under the effect of gravity as a fuel film, in FIG. 1 designated by reference numeral 5, towards the foot 6 or lower end of the moistenable surface 2. At this location of the flow chamber there is arranged, on the one side, a discharge 7 for the fuel-air mixture which is formed in the flow chamber and the flow direction of which is shown in FIG. 1 arrows having the black-white discontinuous lines. The fuel-air mixture is reversed by an angle of 180° and flows, freed of fuel droplets, through a discharge 8. It is then conducted towards a combustion chamber which is not illustrated in the drawing. On the other side, located at the foot 6 is a discharge 9 for excess fuel.

Serving as the discharge 9 for the fuel is a gap between the moistenable surface and the lower closure 10 of the flow chamber 1. The gap has a gap width 11 which is only slightly larger then the film thickness of the fuel film 5 which forms at the foot 6 of the surface. For the discharge of fuel, the gap opens downwardly. This configuration of the discharge 9, on the one hand, allows for an undisrupted discharge of excess fuel and, on the other hand, a discharge of the fuel-air mixture which is free of fuel droplets. The excess fuel which is conveyed off through the discharge 9 passes into a fuel storage 12 which is located below the discharge 9.

The fuel distributor 4 is connected with a fuel chamber 13 for the infeed of fuel and, at the head of the surface which is to be moistened in the embodiment according to FIG. 1, is located immediately in the region of the connection of a combustion air inlet 14 in the flow chamber 1. The fuel which exits from the fuel distributor 4 distributes itself uniformly over the surface which is to be moistened, wherein the distribution and the adherence of the fuel film is enhanced through roughening of the surface. In the exemplary embodiment, the wall 3, on the surface of which the fuel trickles downwardly under the effect of gravity in the flow direction of the combustion air, is constituted of ceramic with a fine-grained surface structure. However, there can also be employed walls which are constructed of metal whose surface are roughened, for example, sandblasted.

Figure 2:
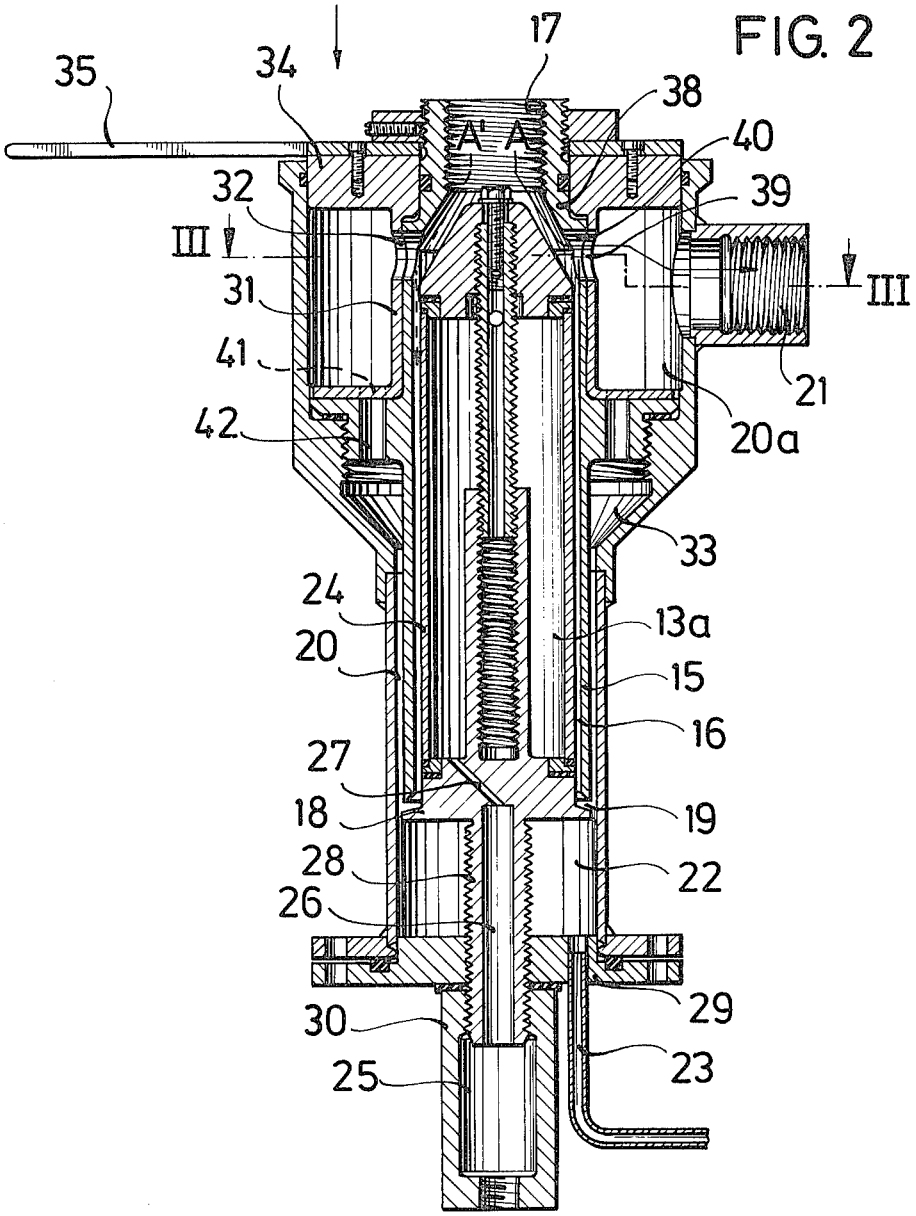
FIG. 2 illustrates a longitudinal section through a flow chamber with an adjustable fuel chamber and with a bypass regulator, taken along line II—II in FIG. 3.

Illustrated in FIG. 2 is an embodiment with a cylindrically constructed fuel chamber 13*a*, which is encompassed, with an interium spacing, by a vertically arranged flow guide 15, so as to form a flow chamber 16 between the outer surface of the fuel chamber 13*a* and the inner wall surface of the flow guide 15 which corresponds to the flow chamber 1 of FIG. 1. The combustion air is introduced at the head of the flow chamber 16 through a combustion air inlet 17. The flow direction of the combustion air which is conducted to the flow chamber 16 is recognizable in FIG. 2 with A′ and through the dash-drawn flow lines. During the passing through of the flow chamber 16 in the direction of the fuel film which streams off towards discharge 18 under the effect of gravity, the combustion air takes up vaporized fuel from the surface which is moistened by fuel. The fuel-air mixture is reversed by an angle of 180° at the foot of the moistened surface at the discharge 19, and flows through an outlet 20 which coaxially encompasses the flow chamber 16 and through a gas chamber 20*a* into a gas conduit 21 conveying the ignitable mixture. In order to prevent cooling of the formed fuel-air mixture, the outlet 20 as well as gas chamber 20*a* and gas conduit 21 are constructed insulated about their outer surfaces. The excess fuel flows through the discharge 18 into a fuel storage 22 from which it can be withdrawn through a supply conduit 23.

In the embodiment according to FIG. 2, the fuel chamber 13*a* includes porous walls 24 through which the fuel which is introduced into the fuel chamber through fuel conduits 25, 26, 27, can exit into the flow chamber 16 distributed over the entire height of the walls 24. This facilitates a uniform resupply of fuel to the entire moistened surface. Through a respective fuel pressure within the fuel chamber there is achieved that more fuel will always trickle down the surface which is to be moistened than that which is vaporized in the warm combustion air which is conveyed within the flow chamber.

Figure 3:
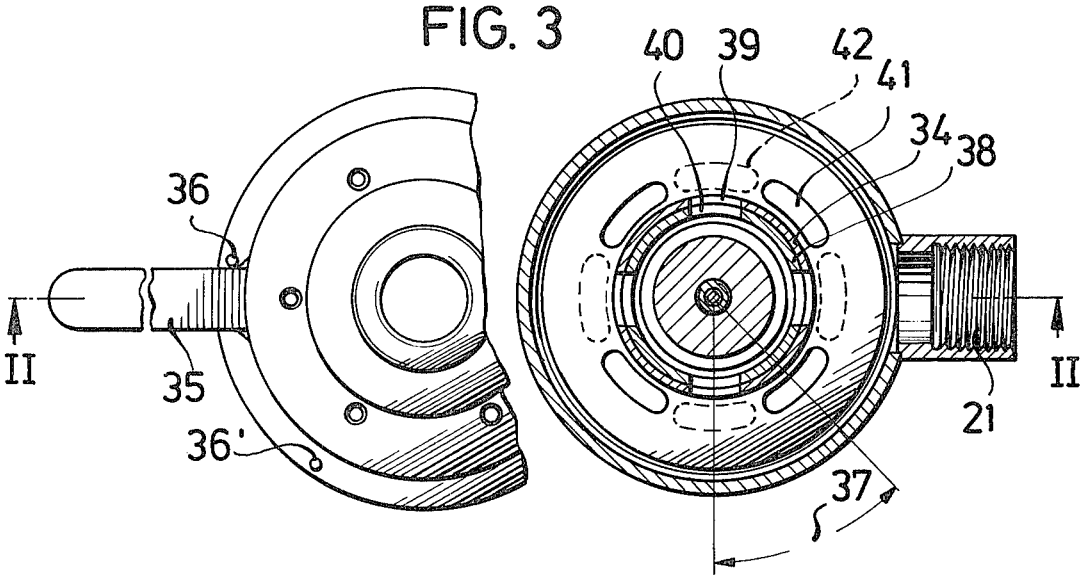
FIG. 3 illustrates a cross-sectional view through the bypass regulator of FIG. 2 taken along line III—III, as well as a partly-sectioned top plan view.

For the regulating and setting of the ignitable mixture of liquid fuel and combustion air which is to be conducted off in the gas conduit 21, the arrangement which is illustrated in FIGS. 2 and 3 allows itself to be regulated in two ways. On the one hand, the size of the surface which is to be moistened by the fuel and which is passed over by the combustion air in the flow chamber, is variable through displacement of the fuel chamber 13*a*. For this purpose, the fuel chamber 13, which is arranged so as to be axially displaceable within the vertically positioned flow guide 15, includes a shank 28 which passes through the fuel storage 22 and is screwable into a base plate 29 of the fuel storage. The shank 28 is conducted to the outside and here adapted to be fixed by means of a clamping sleeve 30. After detachment of the clamping sleeve 30, the fuel chamber 13 can be screwed either out of or into the flow chamber 16 so that the surface moistened with fuel and which is exposed to the combustion air and can be either reduced or increased. The contact surface which stands available for the take-up of vaporized fuel into the preheated combustion air can thus be correlated with the conditions present in the flow chamber pursuant to the quality of the fuel.

Provided as a further regulating unit for the formation of the ignitable mixture is a bypass regulator 31 for the infeed of combustion air to the flow chamber, which renders it possible that only a portion of the quantity of combustion air which flows in the combustion air inlet 17 is introduced into the flow chamber 16. The remaining portion of the combustion air flows through a bypass 32 directly into the fuel-air mixture discharging from the flow chamber 16 through discharge 20 and gas chamber 20*a* into the gas conduit 21. The flow direction of the combustion air which is conveyed through the bypass is marked in FIG. 2 by a flow arrow A drawn in a continuous line. The combustion air which flows off through the bypass is introduced into the gas chamber 20*a*, in which the discharge 20 for the fuel-air mixture interconnects with the distributing chamber 33. The bypass regulator 31 consists of an adjustable regulating element 34 which, in this embodiment is rotatably conducted by means of a lever 35 within an angle 37 predetermined by latching means 36, 36' as shown in FIG. 3, opposite a stationary regulating element fixed on the flow guide 15. In the arrangement illustrated in FIGS. 2 and 3, the flow passageway 15 and regulating element 38 are constructed of a unitary element. The regulating elements 34 and 38 include cutouts 39 and 40 for the formation of the bypass. In this embodiment, the cutouts 39 and 40 are identically shaped and are so arranged, that the cutouts 39 in the adjustable regulating element 34 and the cutouts 40 of the stationary positioned regulating element 38 are superimposed in the "off" position of the bypass regulation, so that the entire combustion air flowing within the combustion air infeed, without entering into the flow chamber 16, will stream out through the bypass 32 into the gas conduit 21. Shown in this position is the bypass regulator 31 in FIGS. 2 and 3.

In the "off" position the bypass regulator 31 closes off the discharge 20 for the fuel-air mixture upstream of the distributing chamber 33. For this purpose, the regulating element 34 includes cutouts 41 which are superimposed by the cutouts 42 in the stationary regulating element 34, which spatially connect the distributing chamber 33 with the gas chamber 20*a*. During displacement of the regulating element 34 with the aid of the lever 35, the cutouts 41 are displaced relative to the cutouts 42. The cutouts 42 are illustrated in FIG. 3 by means of the phantom lines. Should combustion air be introduced into the flow chamber 16, then the regulating element 34 is brought from the "off" position illustrated in FIGS. 2 and 3 into an operative position through reversal of the lever 35. When the lever 35 lies against the latching device 36', then the bypass conduit 32 is closed off and the total combustion air is conducted through the flow chamber 16. In this position, the cutouts 41 and 42 stand above each other while the cutouts 39 and 40 mutually cover each other and thus close off the bypass 32. The ignitable mixture which flows to the fuel chamber through the gas conduit 21 evidences in this regulated position the maximum possible fuel content.

Figure 4:
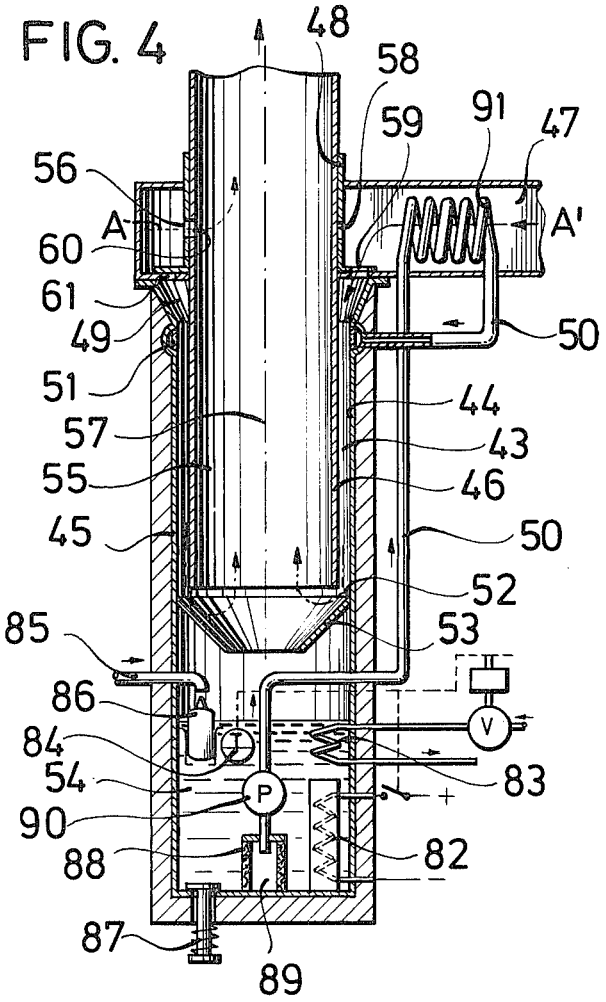
FIG. 4 illustrates a longitudinal section through a flow chamber with fuel storage.

A further embodiment of an inventively constructed arrangement is schematically illustrated in FIG. 4. A flow chamber 43, which corresponds to the flow chamber 1 in FIG. 1, is constructed in this embodiment as an annular gap between the inner surface 44 of a hollow cylinder 45 which is adapted to be moistened by fuel, and the outer wall surface of a flow guide 46 which is inserted vertically from above into the cylinder. The preheated combustion air is introduced into the flow chamber 43 through a combustion air infeed 47. The combustion air flows through a rotationally adjustable regulating element 48, which corresponds to the regulating element 34 in the embodiment according to FIGS. 2 and 3, to the inlet 49 of the flow chamber 43 for regulation of the bypass flow. The flow direction of the combustion air entering the flow chamber is marked in FIG. 4 with an arrow A' shown by extended lines.

For the introduction of fuel into the flow chamber 43, downstream of the inlet 49 through which there flows the combustion air, a fuel conduit 50 connects into a fuel distributor 51. The fuel distributor 51 consists of a ring constituted of ceramic which is permeable to the fuel or also, for example, of a metal ring provided with fine apertures which evidences a flow resistance so high that the fuel will exit uniformly over the entire outer annular surface of the fuel distributor. The fuel distributor 51 is so introduced at the head of the flow chamber 43 into the wall of the cylinder 45 that the outflowing fuel forms a trickling film on the surface 44 which is to be moistened by fuel. The fuel flows under the effect of gravity towards the bottom or foot 52 of the surface 44 which, as in the embodiment according to FIGS. 2 and 3, is roughened to improve the film formation and the adherence of the fuel. From the foot 52, the excess fuel which is not taken up by the combustion air flows through a junction 53 into a fuel storage 54 which is located below the flow chamber 43. By means of the junction 53 the fuel-air mixture discharging from the flow chamber 43 is reversed through an angle of 180°, and flows off free of fuel droplets in the inner space 55 of a flow passageway 46 to a combustion chamber (not illustrated in the drawing). The flow direction of the fuel-air mixture at the outlet of the flow chamber 43 towards the foot 52 of the surface 44 is marked in FIG. 4 with directional arrows in phantom lines.

The adjustable regulating element 48 for regulation of the combustion air flow in the bypass 56 between the combustion air inlet 47 and the inner space 55 of the flow guide 46 is schematically illustrated in FIG. 4 in concurrently two of its regulating positions. At the left side from a center line 57 of the flow guide 46, the regulating element 48 is illustrated in its "off" position with an opened bypass 56 and closed inlet 49 to the flow chamber 43, with the flow direction of the combustion air through the bypass 56 being illustrated by arrow A in dashed lines. At the right from the center line 57, the regulating element 48 is illustrated with a closed bypass 56 and a fully opened inlet 49. The regulating element 48 includes cutouts 58 and 59 which, for regulation of the combustion air flow in the bypass 56, are displaceable with regard to cutouts 60 in the wall of the flow passageway 46 and with regard to cutouts 61 provided in the wall of the combustion air inlet 47. The regulating element 48, in its function, corresponds to the regulating element 34 in FIGS. 2 and 3. However, in contrast with the regulating element 34, the regulating element 48 does not vary a flow cross-section in the discharge of the fuel-air mixture, but varies a flow cross-section in the combustion air infeed ahead of the inlet 49 to the flow chamber 43. The combustion air, upon adjustment of the regulating element 48 out of the "off" position into an operative position, flows through the cutouts 59 and 61 and through the inlet 49 into the flow chamber 43 and herein takes up vaporized fuel. The fuel-air mixture flows in the inner space 55 of the flow passageway 46 which opens downwardly and is spatially connected with the flow passageway 43, towards the combustion chamber.

Figure 5:
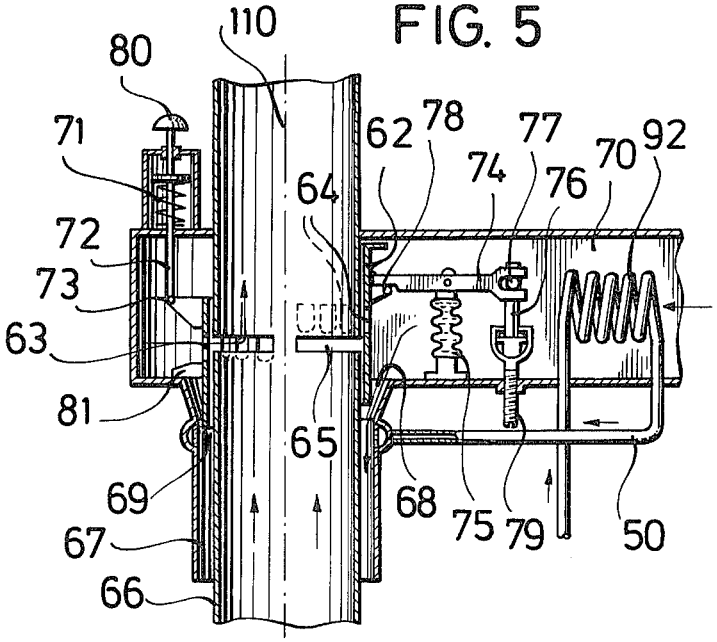
FIG. 5 illustrates a further embodiment of a bypass regulator for the flow chamber of FIG. 4.

A further embodiment for a bypass regulation is illustrated in FIG. 5. In this regulator, the adjustable regulating element is formed as an axially displaceable sleeve 62. Also in FIG. 5 is this regulating element concurrently illustrated in two of its positions; in effect, at the left from a center line 110 is the "off" position of the bypass regulation, at the right of the center line 110 is the operative position at maximum fuel content in the ignitable mixture. The sleeve 62 includes cutouts 64 for the adjustment of the flow cross-section for bypass flow 63, which are displaced relative to slit-shaped cutouts 65 in a flow guide 66, which corresponds to the flow guide 46 in the embodiment according to FIG. 4, during displacement of the sleeve 62. For effecting the regulation of the combustion air flow to the flow chamber 67, which is constructed in the same manner as the flow chamber 43 in the embodiment of FIG. 5, and which includes a funnel-shaped inlet 68, the sleeve 63 is provided with a closure 69 at its end facing towards the flow chamber 67 which, in the "off" position of the bypass regulator, in essence at a fully opened bypass, closes off access to the flow chamber 67.

The sleeve 62 is in operative communication with a temperature sensor which is arranged within a combustion air infeed 70. For this purpose, the sleeve 62 is displaceable against the action of a prestressed spring 71 which is linked through a pull rod 72 on projection 73 on the adjustable sleeve 62, by means of a pivot lever 74. The pivot lever 74 is supported on a support 75 so as to be rotatable in a vertical plane. The support 75 consists of a corrugated tube which is filled with oil, and the length of which changes dependent upon the temperature of the combustion air in the combustion air infeed 70 relative to a linkage 76 to which the pivot lever 74 is pivotally articulated. Upon a rotation of the pivot lever 74 about its fixed point of rotation 77 caused by the support 75, the sleeve 62 is brought into the required operating position through a stop 78 on the sleeve with which the pivot lever 74, in this embodiment, is force-transmissively connected. The location of the fixed point of rotation 77 can also be varied relative to the location of the point of rotation on the support 75 by means of an adjusting screw 79 engaging on the linkage 76. This facilitates the setting of the bypass regulation to different types of fuels which are to vaporized within the flow chamber 67.

The pull rod 72 which is linked to the projection 73 on the sleeve 62 is conducted outwardly and, upon displacement, facilitates through a pushbutton 80 an "off" positioning of the bypass regulation. The extent of displacement of the pull rod 72 is limited by a stop 81 provided on the sleeve 62. When, subsequent to actuation of the pushbutton 80, the pushbutton is again released, then the sleeve 62 is again brought into the operative condition by means of the spring force of spring 71, as is predetermined by the position of pivot lever 74. Through the pushbutton 80 there can also be connected a safety switch.

The fuel storage 54 which in FIG. 4 is illustrated as being arranged below the flow chamber 43, into which there flows off the excess fuel not taken up by the combustion air within the flow chamber, on the one hand, includes a heating element 82 for the preheating of the fuel present in the fuel storage and, on the other hand, also provides for a cooling element 83 which is actuated upon the exceeding of a predetermined fuel temperature in the fuel storage. Heating element 82 and cooling element 83 are controlled by a thermostat 84 which is in contact with the liquid fuel in the fuel storage. For the refilling of fuel, a fuel conduit 85 communicates with the fuel storage, and which is closeable by a float valve 86 controlled by the liquid level in the fuel storage. The fuel storage 54 can be emptied through a closure 87 which is adjustable against the action of a spring, and which is arranged in the bottom of the fuel storage.

From a fuel chamber 89 which is encompassed by a filter 88, the fuel is aspirated by means of a fuel pump 90 out of the fuel storage 54. The fuel pump 90 conducts the fuel into the fuel conduit 50 which leads to the fuel distributor 51. Prior to the fuel exiting from the fuel distributor 51 onto the surface 44 which is to be moistened, the fuel is additionally preheated in a heat exchanger 91 to which there is connected the fuel conduit 50, by means of the combustion air which flows in the combustion air infeed 47. A heat exchanger 92 which corresponds to the heat exchanger 91, in the embodiment according to FIG. 5 is also arranged in the combustion air infeed 70.

When combustion air flows in the combustion air infeed which has been preheated by the exhaust gases of a burner or heating installation, and the ignitable mixture streaming off in the gas conduit serves the same burner or heating installation as combustion gas, it has been indicated that the temperature of the preheated air which is conducted to the flow chamber changes in dependence upon the air throughput, and that this temperature change can be employed for bypass regulation. Through the utilization of a temperature sensor in the combustion air infeed, which in the modification of the temperature sensor illustrated in FIG. 5, can for example, also be electronically constructed, there is automatically produced an optimum fuel-air mixture in dependence on the air throughput, since herein also the temperature of the fuel which is circulated at a constant quantity and is preheated by the combustion air, is influenced in dependence upon the temperature present in the combustion air infeed.

Figure 6:
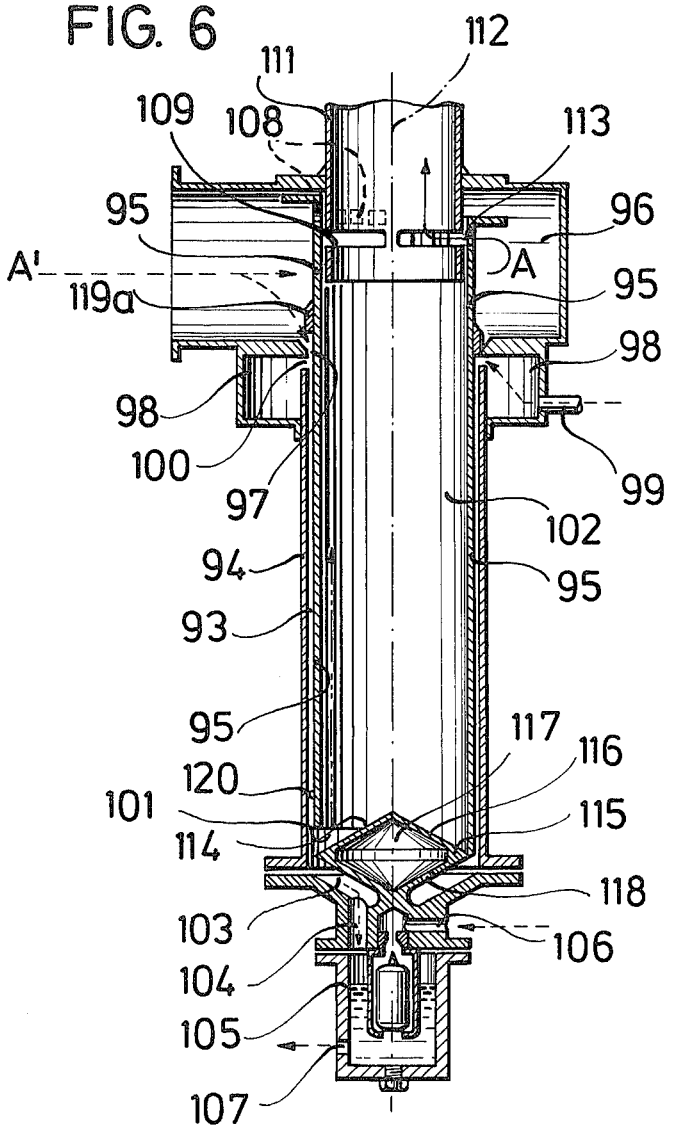
FIG. 6 illustrates a flow chamber with a bypass regulator which completely closes off the flow chamber at an opened bypass.

A further exemplary embodiment of a bypass regulator with axially displaceable regulating elements is schematically illustrated in FIG. 6. A flow chamber 93 which, in the same manner as in the embodiments pursuant to FIGS. 3, 4 and 5, is constructed as an annular space between the inner surface of a hollow cylinder 94 and the outer wall surface of a flow guide 95, serves for the take-up of fuel into the combustion air. The combustion air is introduced into the flow chamber 93 through a combustion air infeed 96 and an inlet 97 which narrows towards the flow chamber 93. The fuel is added to the interior surface of the hollow cylinder 94 from a fuel chamber 98 into which there connects a fuel conduit 99. The fuel flows through an annular gap 100 onto the interior surface of the hollow cylinder 94. The width of the gap is so dimensioned that the fuel will moisten the entire surface of the hollow cylinder which is streamed about by combustion air and, under the effect of gravity, will trickle down to the discharge 101 for the fuel-air mixture at the lower end of the flow chamber 93. At this location, the fuel-air mixture is reversed through an angle of 180° and conveyed off in the interior space 102 of the flow guide 95, so that the flow guide 95 which borders the flow chamber 93 along its inside concurrently serves for the discharge of the fuel-air mixture.

From the outlet 101 the fuel is conveyed through a fuel collector 103 and a discharge 104 which is connected thereto to the fuel storage 105. The fuel storage includes a fuel infeed 106 and discharge 107 which, analogously with the embodiment pursuant to FIG. 4, has the fuel conduit 99 connectable thereto so that fuel added in excess is reusable for the formation the fuel-air mixture. The fuel pump which is required herewith for the fuel circulation is not illustrated in FIG. 6.

For the regulation of the bypass flow which is introduced from the combustion air infeed 96 into the fuel-air mixture discharging from the flow chamber 93, in the embodiment pursuant to FIG. 6 the flow guide 95 itself serves as an axially displaceable regulating element. The displacement of the flow guide is effected in the manner as illustrated in the embodiment pursuant to FIG. 5 in dependence upon the temperature of the combustion air flowing in the combustion air infeed 96 through the intermediary of a temperature sensor which is inserted in the combustion air infeed. In FIG. 6, these control organs for the displacement of flow guide 95 are not again illustrated so as to simplify the representation. As a regulating element, the flow guide 95 includes cutouts 108 in the region of the combustion air infeed which, during axial displacement of the flow guide allow themselves to be slid over cutouts 109 which are provided in a gas discharge 111 for the fuel-air mixture. The gas discharge 111 is welded into the combustion air infeed and thereby, with regard to the flow guide 95 which as is indicated hereinabove is inserted as a displaceable regulating element, forms a stationary regulating element. The cutouts 109 in the gas discharge 111 extend in a plane which is normal to the tube axis 112 of the gas discharge and are slit-shaped.

In FIG. 6, the flow guide 95 is illustrated as a displaceable regulating element in concurrently its two extreme positions. At the left of the tube axis 112 there is illustrated the operative position in which the fuel-air mixture evidences the maximum fuel content, at the right side of the tube axis 112 there is represented the "off" position of the regulating element at a fully opened bypass 113 and closed flow chamber 93.

For the two extreme positions of the bypass regulator there is illustrated through flow arrows the flow of the combustion air. On the left side of the conduit axis 112 there is marked through flow arrow A' and dashed flow line the entry of the combustion air into the flow chamber 93, on the right side there is indicated the outflow of the combustion air through the bypass 113 into the gas discharge 111 by the flow arrow A and the continual flow line. In the last-mentioned regulator position, the flow chamber 93 is completely closed off by the flow guide 95. For this purpose, the flow guide 95 includes, on the one side, sealing elements 119*a* in the region of the inlet 97 to the flow chamber 93, which are annularly arranged on the outer shell of the flow guide 95 and, upon opening of the bypass 113, are so introduceable into the inlet 97 that access to the flow chamber 93 is closed at a fully opened bypass. On the other side at a fully opened bypass on the foot 114 of the flow guide 95, there is also closed the discharge 101. As illustrated in FIG. 6 at the right of the conduit axis 112, the foot 114 of the flow guide 95 is seated on a base 115 at the fully opened bypass, which closes off towards the bottom the inner space 102 of the flow guide 95 provided for the discharge of the fuel-air mixture. The base 115 is shaped so as to incline downwardly towards the fuel collector 103, so that any fuel which may remain in the region of the base is conveyable into the fuel collector 103.

In this embodiment, the base 115 is shown as being of lightweight construction. The base includes a conical cap 116 facing towards the interior space 102 of the flow guide 95, which is mounted on the foot of the base, so that the thereby formed hollow space 117 in the base can be depressurized through a vent bore 118. The flow guide 95 is centered in the lower portion of the flow chamber 93 by means of guides 120.

Through the arrangement which is schematically illustrated in FIG. 6, at a fully opened bypass there is completely avoided the emission of uncombusted fuel into the gas conduits which then merely conduct combustion air; namely, into the combustion air infeed 96 and into the interior space 102 of the flow guide 95. This, above all, facilitates the warming up of the oil prior to the starting up of the installation and also the switching off of the installation without contamination of the environment and loss of fuel.

Figure 7:
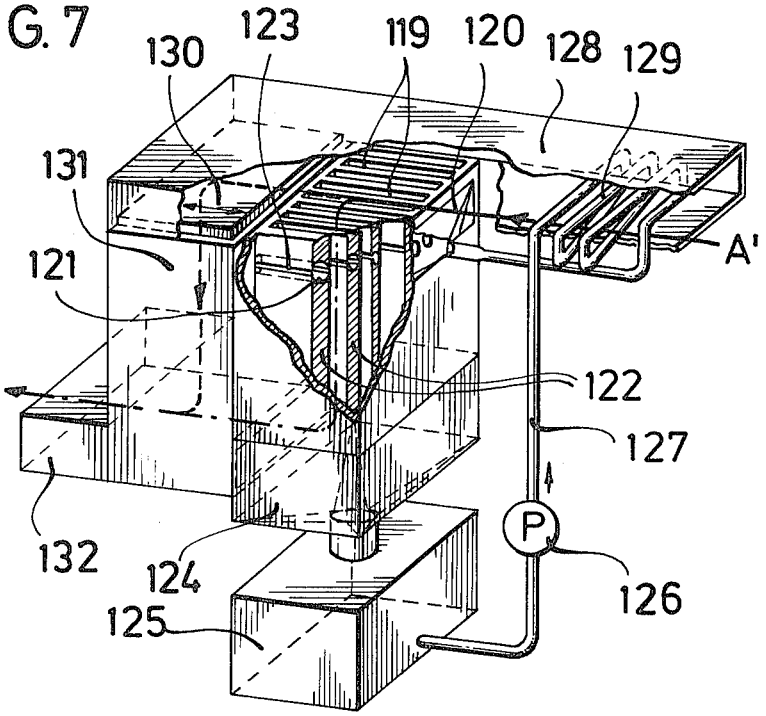
FIG. 7 illustrates a generally perspective, partly broken view of a multiple chamber-flow chamber.

A further embodiment of the inventive arrangement is illustrated in FIG. 7. As its flow chamber, the arrangement includes a plurality of mutually parallel extending flow passageways 119 for the combustion air. Each combustion passageway 119 has fuel conveyed thereto through a fuel distributor 120, which trickles through the flow passageway as fuel film. The fuel is conducted from the fuel distributor 120 into blind bores 121 which are provided in the walls 122 of the flow passageway 119 along its entire longitudinal extent. The blind bores 121 are spatially connected through slit-shaped cutouts 123 in the walls 122 with the flow passageways 119, wherein the width of the cutouts 123 is so dimensioned that, for a uniform outflow of the fuel over the entire surface of the flow passageways 119 which is streamed about by the combustion air, there is produced an adequate flow resistance for the inflowing fuel.

From the flow passageways 119, the excess fuel flows through a juncture 124 into a fuel storage 125 which is located below the flow passageways 119. The fuel is conveyed from the fuel storage, in the same manner as illustrated in the embodiment in FIG. 4, by means of a fuel pump 126 located within a fuel conduit 127, to a fuel distributor 120. The fuel conduit 127 is conducted through a heat exchanger 129 which is arranged in a combustion air infeed 128.

For the adjustment of the ignitable mixture for the combustion chamber, in the embodiment according to FIG. 7 there is arranged, at the open side of the flow passageways 119 facing towards the combustion air infeed 128, a regulating element 130 which is displaceable in the direction indicated by the arrow, through which there can be changed the flow cross-section at the inlet to the flow passageways 119. Concurrent with the displacement of the regulating element 130 there is either opened or closed a bypass 131 which can be streamed through by the combustion air in parallel with the flow passageways 119 for regulating the combustion air infeed to the flow passageways 119. The bypass 131 is indicated in FIG. 7 through a dashed flow line for the combustion air in the bypass. In FIG. 7 the regulating element 131 is represented in an operative position in which the entire combustion air flowing within the combustion air infeed 128 is conveyed in the direction of the flow arrow A' (extended flow line) through the flow passageways 119. From the outlet of the flow passageways, a gas discharge 132 conducts the fuel-air mixture to a combustion chamber (not shown). The "off" position of the regulating element 130 is illustrated in the exemplary embodiment according to FIG. 6 with a complete covering of the inlets to the flow passageways 119.

In all embodiments the ignitable mixture allows itself to be extremely precisely correlated over broad ranges with the required operating condition as would occur at the different power requirements in burner and heating installations. The mixture burns soot-free and leads to a low proportion of carbon monoxide components in the exhaust gas. Thereby, all apparatuses are not only ruggedly constructed, but are also simple in their manipulation. The combustion air infeed in the flow direction of the fuel-trickle film which is formed under the effect of gravity on the moistenable surface, and the bypass regulation for the infeed of combustion air into the flow chamber, in which a portion of the combustion air while bypassing the flow chamber is directly introduced to the fuel-air mixture formed in the flow chamber for adjustment of the ignitable mixture which is to be conducted to a combustion chamber, leads to an extremely precise regulation. As the regulating parameter there is hereby employed the temperature of the combustion air. This is particularly of advantage when the combustion air is preheated by the exhaust gases from the combustion chamber. The mutual dependence of the adjusted ignitable mixture, temperature within the combustion chamber and temperature of the combustion air which has been preheated by the exhaust gases in the combustion air infeed, as well as the temperature of the fuel which is preheated by the combustion air which takes up the vaporized fuel, leads to a regulating cycle which automatically adjusts the ignitable mixture with the necessary fuel content for the required heat output in the combustion chamber.

What is claimed is:

1. In a process for the formation of an ignitable mixture of liquid fuel and combustion air, including conducted preheated combustion air for taking up fuel within a flow chamber along a surface moistened by fuel; the improvement comprising in conducting the combustion air through the flow chamber in the flow direction of the fuel flowing off the surface under the effect of gravity, dosing in the fuel to an excess, introducing a regulatable bypass flow from the combustion air which is conveyed into the flow chamber into the fuel-air mixture formed in the flow chamber, including regulating the combustion air quantity conveyed through the flow chamber and bypass so that at a fully opened bypass there is prevented flow of the fuel-air mixture towards a mixture discharge, and discharging fuel not taken up by the combustion air from the foot of the flow chamber.

2. In an arrangement for the formation of an ignitable mixture of liquid fuel and combustion air including a surface moistenable with fuel for the inlet of fuel; and a flow chamber having said surface therein, said flow chamber being passed through by preheated combustion air being conducted to a combustion zone; the improvement comprising in combustion air inlets for the combustion air and outlets for the fuel-air mixture being formed in the flow chamber so that the combustion air passes through the flow chamber in the flow direction of the fuel flowing off the moistened surface under the effect of gravity, a regulatable bypass being connected with the discharge for the fuel-air mixture communicating with the combustion air infeed ahead of the combustion air infeed connection with the flow chamber; a regulator for the combustion air which passes through said flow chamber and said bypass wherein said regulator includes means for preventing flow of the fuel-air mixture towards the fuel-air mixture outlet at a fully opened bypass; and a discharge for excess fuel in the flow direction of the fuel being arranged at the foot of the surface in said flow chamber moistened by the fuel.

3. Arrangement as claimed in claim 2, comprising a gap forming a discharge at the foot of the surface moistened by the fuel, said gap having a width corresponding at least to that of a film thickness of a fuel film formed at the foot of the surface moistened by the fuel.

4. Arrangement as claimed in claim 2, comprising a temperature sensor in operative connection with the regulator being arranged in the combustion air infeed.

5. Arrangement as claimed in claim 2, including two latching means, said regulator being displaceable between said latching means.

6. Arrangement as claimed in claim 2, wherein said flow chamber includes a plurality of mutually parallel extending flow passageways for the combustion air.

7. Arrangement as claimed in claim 2, wherein said the regulator includes at least one regulating element which, at a fully opened bypass, concurrently closes a flow cross-section at the inlet of the combustion air to the flow chamber or a flow cross-section in the discharge for the fuel-air mixture upstream of the bypass.

8. Arrangement as claimed in claim 7, wherein said regulator includes two regulating elements displaceable relative to each other.

9. Arrangement as claimed in claim 7, said regulating elements being tubular and being arranged coaxially relative to each other, at least one of the regulating elements being displaceably supported.

10. Arrangement as claimed in claim 7, wherein said regulating elements have cutouts therein for passage of the combustion air.

11. Arrangement as claimed in claim 2, comprising a connection at the foot of the fuel-moistened surface for the fuel which communicates with a fuel storage.

12. Arrangement as claimed in claim 11, including a heating element in the fuel storage for preheating said fuel.

13. Arrangement as claimed in claim 12, including a cooling element in the fuel storage for cooling said fuel.

* * * * *